US009883708B2

(12) United States Patent
Lewis et al.

(10) Patent No.: US 9,883,708 B2
(45) Date of Patent: Feb. 6, 2018

(54) TIARA WITH INTERCHANGEABLE DISPLAY ELEMENTS

(71) Applicants: Sondra Lewis, Herndon, VA (US); Alexis McKenzie, Mt. Airy, MD (US)

(72) Inventors: Sondra Lewis, Herndon, VA (US); Alexis McKenzie, Mt. Airy, MD (US)

( * ) Notice: Subject to any disclaimer, the term of this patent is extended or adjusted under 35 U.S.C. 154(b) by 388 days.

(21) Appl. No.: 13/889,002

(22) Filed: May 7, 2013

(65) Prior Publication Data

US 2014/0259289 A1 Sep. 18, 2014

Related U.S. Application Data

(60) Provisional application No. 61/794,381, filed on Mar. 15, 2013.

(51) Int. Cl.
*A42B 1/00* (2006.01)
*A44C 15/00* (2006.01)

(52) U.S. Cl.
CPC ..... *A42B 1/004* (2013.01); *A44C 15/006* (2013.01)

(58) Field of Classification Search
CPC ..... A42B 1/004; A42B 1/24; A42B 1/248; A44C 15/006; A44C 17/02; A47G 1/12
See application file for complete search history.

(56) References Cited

U.S. PATENT DOCUMENTS 1,430,995 A * 10/1922 Holman ..... A42B 1/248 40/329
2,838,868 A * 6/1958 Young ..... A01K 97/06 43/57.2
2,866,204 A * 12/1958 Mayer ..... A42B 1/041 2/174
3,031,681 A * 5/1962 Hoeflich ..... A42B 1/16 2/200.3
3,179,954 A * 4/1965 Weitzner ..... A42B 1/16 132/53
4,389,801 A * 6/1983 Sharrock ..... A41D 27/20 2/247
4,985,935 A * 1/1991 Hur ..... A42B 1/004 2/10
5,121,507 A * 6/1992 Brown ..... A42B 1/004 2/10
5,427,123 A * 6/1995 Odenthal ..... A45D 8/00 132/275
5,826,597 A * 10/1998 Chou ..... A45D 8/36 132/273
5,829,063 A * 11/1998 Cheng ..... A42B 1/248 2/209.13
5,926,848 A * 7/1999 Bartholomae ..... A45D 8/00 132/273

(Continued)

FOREIGN PATENT DOCUMENTS

JP 2006175056 A * 7/2006

*Primary Examiner* — Sally Haden

(74) *Attorney, Agent, or Firm* — Simana Rao, Esq.; McNeely, Hare & War LLP

(57) ABSTRACT

The invention relates to a head covering such as a tiara having a display element attached thereon which may be easily interchanged by the user to increase the versatility of the head covering and allow the user to switch in display elements having varying shapes and sizes. The head coverings may be used by adults at sporting events and/or by children playing dress-up, for example.

8 Claims, 8 Drawing Sheets

(56) References Cited

U.S. PATENT DOCUMENTS

| | | | | |
|---|---|---|---|---|
| 6,049,912 | A * | 4/2000 | Linehan | A45D 8/00 132/275 |
| 6,477,714 | B1 * | 11/2002 | Boatwright | A42B 1/24 2/171 |
| 6,688,316 | B1 * | 2/2004 | Klug | A45D 8/00 132/275 |
| 7,156,106 | B2 * | 1/2007 | Lawson | G02C 11/02 132/275 |
| 7,473,004 | B1 * | 1/2009 | Tsai | A44C 15/0015 362/104 |
| 7,490,364 | B2 * | 2/2009 | Kim | A42B 1/248 2/209.13 |
| 8,763,163 | B1 * | 7/2014 | Johns | A42B 1/004 2/195.1 |

* cited by examiner

TIARA WITH INTERCHANGEABLE DISPLAY ELEMENTS

CROSS-REFERENCE TO RELATED APPLICATION

The present application relates to, and claims priority to U.S. Provisional Patent Application Ser. No. 61/794,381 filed on Mar. 15, 2013, which is entitled "Tiara with Interchangeable Element." The content of this priority application is incorporated herein in its entirety by reference.

TECHNICAL FIELD OF THE INVENTION

This invention relates to head coverings such as tiaras having a display element attached thereon which may be easily interchanged by the user to increase the versatility of the head covering and allow the user to switch in display elements having varying shapes and sizes. The head coverings may be used by adults at sporting events and/or by children playing dress-up, for example.

BACKGROUND OF THE INVENTION

The popularity of sporting events in the United States and around the world has been growing at an unprecedented pace and shows few signs of slowing down. In sports such as golf, football, auto racing, basketball and baseball, etc., one of the more popular forms of advertising that companies purchase is what is called "logo advertising." Logo advertising generally consists of positioning a corporate logo on an article of clothing that is worn by the event participants. Although sporting teams derive substantial revenue from logo advertising on clothing such as caps, shirts or jerseys, for example, there is a significant deficiency in products specialized for women and children who are equally as enthusiastic as men about the sporting teams they follow.

Women following sporting events oftentimes dislike the standard baseball caps, visors and jerseys available for purchase and would prefer to wear something more feminine if it were available to them. There are currently no known tiaras on the market that display corporate logo advertising. Furthermore, there are no known tiaras on the market that allow versatility to the user by allowing the user to switch out the element being displayed on the tiara, whether it be a corporate logo, symbol, insignia, photograph, business card, or other display element.

U.S. Pat. No. 2,866,204 discloses a flexible tiara which projects upwardly from a headgear, such as a hairnet or skull cap, and can be attached to the headgear by threading loops contained on the headgear through a series of apertures on the surface of the tiara. The tiara is made of a resilient and flexible material, such as textile, and can thus be manipulated around the head of the wearer such that each aperture of the tiara can be attached to each loop of the headgear. There is no teaching of an additional display element on the outer surface of the tiara, nor is there any teaching of the interchangeability of a display element.

While baseball caps and hats having interchangeable logos are known in the art, these clothing items typically use a hook and pile fastening material such as VELCRO as a method of attaching and detaching elements. However, there are associated disadvantages with the use of this fastening method for an extended period of time and/or after repeated changing of elements, such as degradation of the VELCRO material itself. For example, the pile material eventually pulls away from the stiffening material and therefore the appearance of the elements is compromised. Furthermore, oftentimes these types of fasteners can be very difficult to remove and consequently, much force is exerted on the pile material which can result in the pile material stretching or even ripping after repeated removal of elements. This rough handling of the elements being interchanged also encourages the elements to break, tear or tatter as they are switched in and out over time.

Furthermore, baseball caps and visors have a smooth substrate upon which fastening elements may be secured which is optimal for the use of hook and pile fastening materials. While VELCRO may work well for attaching fabric elements together, this type of attachment method is not preferred when attaching a display element to a surface having a varying depth, wide gaps between surfaces and a surface with thin wire patterns with the wire sometimes having indentations thereon. The outside surface of a tiara includes all of these aforementioned characteristics and therefore presents additional challenges in developing and designing a fastening method which allows a display element to be attached/detached with ease by the wearer and without damaging the tiara or display element after repeated use. Clothing and baseball caps having a cloth or fabric substrate are thus very easy to manipulate, pierce, puncture, and bend in comparison to the front surface of a tiara.

It is also desirable to have a tiara having interchangeable display elements which are aesthetically pleasing such that none or little of the securing means can be viewed. In particular, there are no tiaras known to have an interchangeable securing means which is hidden from the onlooker and also allows elements of varying shapes and sizes to be interchanged with ease by providing an element to the securing means which allows for adjustability.

As a result, there is a need for a tiara having interchangeable display elements which are secured to the tiara using a sturdy fastening method such as that which is disclosed herein. Such fastening method has various advantages over other methods such as glue, tape, or double sided tape which have proven to be messy, difficult to use, unreliable for the wearer and not aesthetically pleasing.

SUMMARY

In one general aspect there is provided a tiara having an interchangeable display element that is made up of a C shaped band member configured to be worn around the head of a wearer, the band member having a bottom surface configured to be in contact with the wearer's head, a top surface, an inward facing surface and an outward facing surface, an ornamental crown section being secured to the top surface of the band member at one or more points along the band member and extending up from the band member along the same plane as the band member, the crown section including an outward facing side having a plurality of ornamental gaps on its surface, and a means for removably attaching one or more display elements on the outward facing side of the crown section.

Embodiments of the tiara may include one or more of the following features. For example, the means for removably attaching a display element may include a mating means. The mating means may include clips, hooks, snaps and prongs. These may be secured to the outward facing surface of the band member or the outward facing side of the crown section.

The means for removably attaching a display element may include a housing assembly mounted on the outward facing side of the crown section configured to house the display element and having one or more openings through which the display element may be inserted and removed. The housing assembly may include at least one outward facing side which is constructed of a transparent material, such as glass or a plastic material.

The means for removably attaching a display element may include two magnetically attractive materials.

The display element may include a ridge or indentation along at least a portion of its perimeter.

In a second general aspect there is provided a method of making a tiara having an interchangeable display element which includes providing a tiara having a C-shaped band member configured to be worn around the head of a wearer, the band member having a bottom surface configured to be in contact with the wearer's head, a top surface, an inward facing surface and an outward facing surface, and an ornamental crown section being secured to the top surface of the band member at one or more points along the band member and extending up from the band member along the same plane as the band member, the crown section including an outward facing side having a plurality of ornamental gaps on its surface, and securing at least one means for removably attaching one or more display elements on the outward facing side of the crown section.

DETAILED DESCRIPTION

Figure 1:
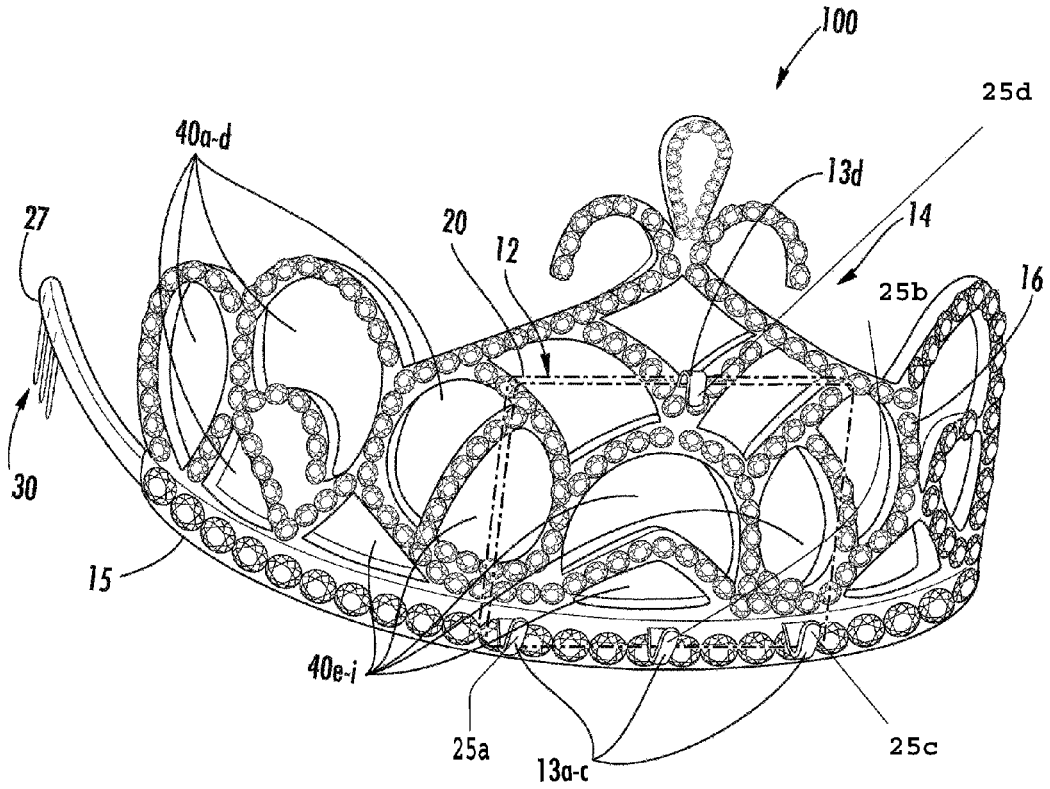
FIG. 1 is a view of a first embodiment of the invention having plastic hooks.

Referring to FIG. 1 is a tiara 100 which includes frame assembly 14 and display portion 11. The frame assembly includes a series of spaced apart sections 40*a-i*, formed by various turns and intersections of wire 16, which may be composed of any polymeric material (i.e., plastic) and/or metal and/or textile material. The wire 16 of the tiara 100 projects upwardly from the band member 15 in an ornamental pattern. The various turns and intersections of the wire may form any range of patterns and motifs, such as a leaf motif or a heart motif, for example. Shown in the figures is a tiara constructed of wire 16 forming various geometric and non-geometric shapes.

The wire 16 may be embellished with a number of stones of precious or semi-precious nature. The wire may also be embellished with a number of decorative elements such as rhinestones, ribbon, stickers, beads, buttons and other decorative items.

The lower edge of the frame assembly defines a band member 15 having a semi-circle shape and configured to be worn around a user's head. Each end of the band may include at least one securing member 29 which may be a clip or a comb 30 as is shown in the figures. Each one of the combs 30 may be comprised of an elongate shaft having a comb portion having a plurality of teeth. The comb thus provides quick and easy securing of the band member 15 to the wearer's head by engaging the wearer's hair.

The band member 15 may be formed of a generally rigid material such as metal or plastic, although other materials having varying flexibility characteristics may be used. The band member 15 may have a rectangular cross sectional shape but may also have a circular cross sectional shape or an alternative cross sectional shape.

The wire 16 forms a tip at the highest point of the tiara, shown in FIG. 1 to culminate in a teardrop shaped jewel. The band member 15 defines a band plane and the wire 16 is mounted to the band member at various points along the circumference of the band member. The wire forms a design that generally stays on the same plane as the band plane and projects upwards from the band member along the band plane. The frame assembly 14 also includes a display area 12. The display area 12 in one embodiment is located on the front center portion of the tiara, as is shown in the figures. However, depending on the particular usage desired, the display area 12 may be located on any outside surface of the tiara at any point along the band plane. The display area 12 may be a flat surface or may be composed of portions of wire and gaps there-between. The display area 12 may be constructed of the same or different material as the wire 16 or the remainder of the tiara.

The attachment member 11 is located in the same area as the display area 12 and serves as the mode of attachment and detachment of the display element from the display area. FIG. 1 shows one or more hooks 13*a-c* secured to the band member 15 which serve as the means of attaching and detaching the display element 20. The hooks 13 may be constructed of a variety of materials including plastics and/or metals. In one embodiment the hooks are constructed of an aluminum or steel material. In another embodiment the hooks are constructed of a clear hard plastic material. In another embodiment, the hooks are constructed of a soft plastic material which can be bent or shaped according to the shape of the display element 20. In each of these embodiments the hooks may be secured to the tiara at various points along the band member with minimal obstruction of the band member. The hooks may also be clear in color. The hooks may be secured to the band member using adhesive such as epoxy or industrial strength glue, or may also be secured using a compression fit portion which begins on the inside surface of the band and extends along the underside surface of the band and around to the outside surface of the band.

The hooks may also be constructed of a rubber material and compression fit in the same manner as described above such that various sizes and shapes of the display element can be attached and detached from the tiara.

The frame assembly 14 can include any variety of different materials and designs commonly employed in conventional tiara/crowns. To wear the tiara, the user simply grasps the end sections 27 and 28 and places the tiara on her head in the desired position. The tiara may be slid back slightly along the hair so the comb member 30 engages the hair to hold the tiara securely to the head. Before wearing the tiara, the user may choose the display element he/she wishes to show. If one is already installed in the display area 12, the user simply grasps the display element and exerts a force upwards so as to disengage the display element from the one or more hooks 13. The hooks remain in place on the band member of the tiara and may then be fitted with a different display element 20.

In one embodiment, the display element 20 is constructed to have a particular dimensions to enable fitting the display element into the attachment member 11. For example, the display element may have a threshold minimum length along its bottom edge such that the display element will mate with the hooks which have been placed along the circumference of the band member 15. In one embodiment, three hooks may be installed on the band member which are placed about 1 inch apart from each other. In order to facilitate easy fitting of display elements having different shapes and sizes, the display elements manufactured for interchangeability with the tiara would have dimensions such that each include a relatively straight bottom edge having a length of 3 inches. In this way, the shape of the display element may be varied while still having the ability to be secured to the one or more hooks located on the lower band member 15.

In another example, hook 13*d* may be installed on the wire 16 along the band plane such that a display element 20 could be secured by maintaining a particular distance between hook 13*a* and 13*d*. For example, the distance between hook 13*a* and 13*d* may be approximately 3 inches and the display element 20 manufactured to be interchanged within the display area would likewise have dimensions such that a diagonal can be drawn having a length of 3 inches.

The display element 20 may include a wide variety of ornamental, informational, or advertising material such as logos, insignias, photographs, business cards, banners. In one embodiment, the display element 20 is in the form and shape of a sporting team mascot, such as a raven for the Baltimore football team or an oriole for the Baltimore baseball team. The desired logo may be silk screened onto a pre-cut or pre-molded piece having a shape to conform with the desired logo.

The letters and logos of different sporting teams present the problem of needing one method of attaching and detaching display elements which vary drastically in their shape and size. The present invention resolves this problem by providing a number of hooks which fit along the circumference of the band member 15 with each hook having a slight lip, 25, so as to secure the display member along its bottom edge. The display element 20 may include an indentation or ridge, 26, along its circumference in order to mate with the lip (25*a-d*) of each hook. The hooks may also be pliable or bendable such that they can be manipulated by the user according to the thickness and shape of the display member.

Preferably, the tiara of the present invention is to be purchased as a singe piece with one display element, where the user may pick and choose from a variety of additional display elements to interchange with the original display element the tiara was sold with. For example, a Baltimore Ravens fan could purchase a tiara having an interchangeable Raven mascot display element. From the same or different vendor, the individual could purchase another display element, such as a Baltimore Orioles mascot display element during the baseball season, and a Maryland Terrapins mascot display element to wear during college basketball games.

The display element may have various shapes and sizes and may take on several different forms, as is shown in FIGS. 6A, 6B, 6C and 6D. The display element can also be constructed of various materials, such as plastic, metal, textile or cloth materal.

Figure 2:
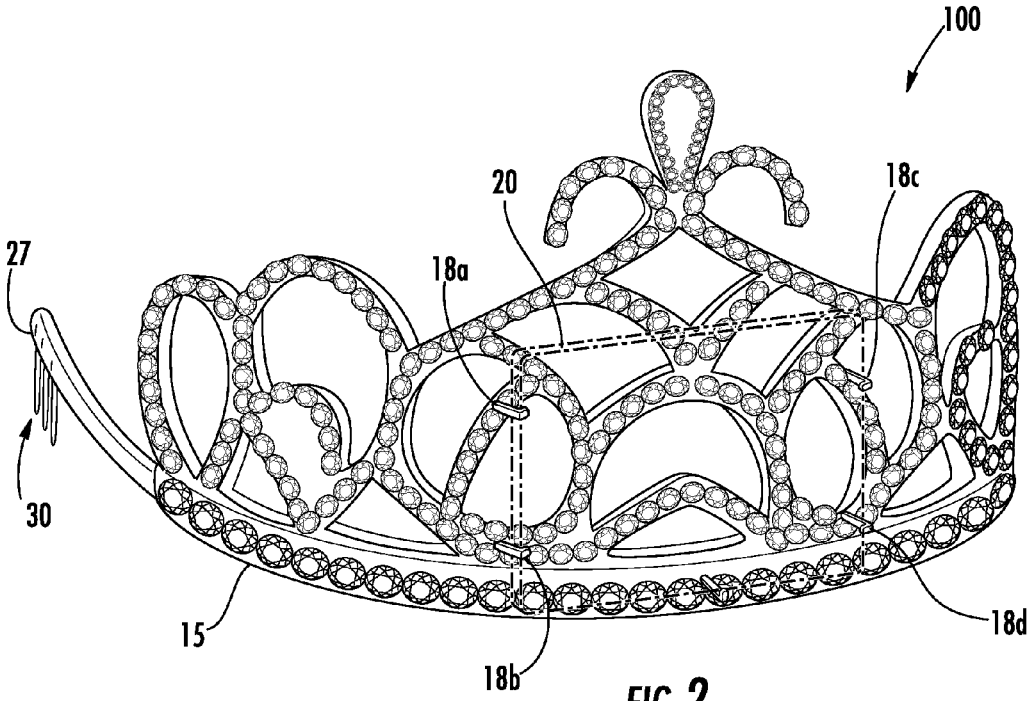
FIG. 2 is a view of a second embodiment of the invention having prongs.

Referring to FIG. 2 is a tiara having an alternative attachment member 11 in the form of one or more prongs 18*a-d*. The one or more prongs may be constructed of a clear plastic material, metal or rubber material. The prongs may be designed to include a slight lip on its end such that the display element 20 can be "locked" or lock fit in place. In one embodiment each display element may also include a slight indentation or ridge along its circumference in order to mate with the lip of the each prong. When the display element is in place sitting within the prongs, the display element may sit at a slight distance outward from the tiara in a direction generally perpendicular to the band plane. The distance will depend on the length of each prong, which may be approximately from about 3 mm to about 10 mm.

To detach the display element 20 from the one or more prongs, the user may exert a force on the display member which is generally perpendicular to the band plane such the ridge or indentation along the circumference of the display member disengages from or "unlocks" with the one or more prongs. The display element can then be easily retrieved by the user. The prongs may be secured to the outside surface of the tiara on the wire 16 by any conventional means. In a preferred embodiment the prongs are secured using an adhesive such as epoxy or industrial strength glue.

The prongs may be placed on the outside surface of the tiara in a number of different configurations depending on the specifications of the display element 20. For example, the one or more prongs may form a circle shape, as is shown in FIG. 2. In another embodiment, the prongs may form a triangle or square shape. The placement of prongs on the surface of the tiara is not meant to limit this invention in any way.

In one embodiment, the display element 20 is designed to have a particular dimensions to enable fitting the display element into the attachment member 11. For example, the display element may have a threshold minimum bottom length such that the display element will mate with the prongs which have been placed along the outside surface of the tiara. In one embodiment, the prongs 18*b*, 18*c*, and 18*d* are placed in a semi-circle shape which are about ½ inch distance apart. In order to facilitate easy fitting of various display elements, the display elements manufactured for interchangeability with the tiara would have dimensions such that each include a relatively curved bottom edge having lower circumference to mate with the prongs which have been placed in a semi-circular orientation. In this way, the shape of the display element may be varied while still having the ability to be secured to the one or more prongs located on the outside surface of the tiara.

Figure 3:
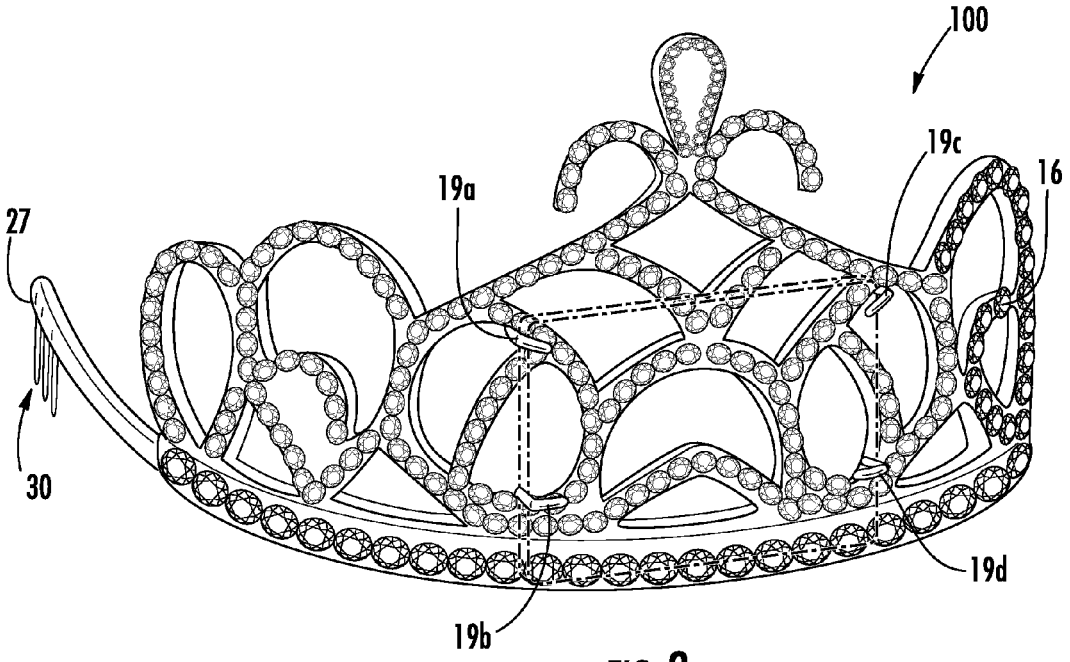
FIG. 3 is a view of a third embodiment of the invention having clips.

Referring to FIG. 3 is a tiara having an alternative attachment member 11 in the form of one or more clips 19*a-d*. The one or more clips may be constructed of a plastic, metal or rubber material, and preferably is constructed of a hard or soft plastic material or metal material. The clips may be secured to the tiara using an adhesive such as epoxy or industrial strength glue. In use, the clips when constructed of a hard plastic material contain a hinge which allows each clip to be engaged into an open and closed position. To secure the display element 20, the user may orient each clip into the open position and place the display element within the display area such that at least one point along the edge of the display element is in contact with one or more clips. The user may then orient each clip into the closed position which allows each clip to press on or exert tension on the display element such that the display element is secured within each clip.

In another embodiment, when the clips are constructed of a softer plastic or metal material, the clips may be manipulated by the user to attach and detach a display element. The clips may be oriented on the outside surface of the tiara or wire 16 in any desired shape. In FIG. 3, the one or more clips 19*a-d* are oriented in a square or rectangular shape with each side having a length ranging from about 0.25 in to about 2.5 in. As has been explained with respect to the prong and hook attachment members, the display element may be sized so as to mate with the one or more clips based on the orientation of the clips on the surface of the tiara or wire 16. The placement of clips along the outside surface of the tiara is not meant to limit this invention in any way.

Figure 4:
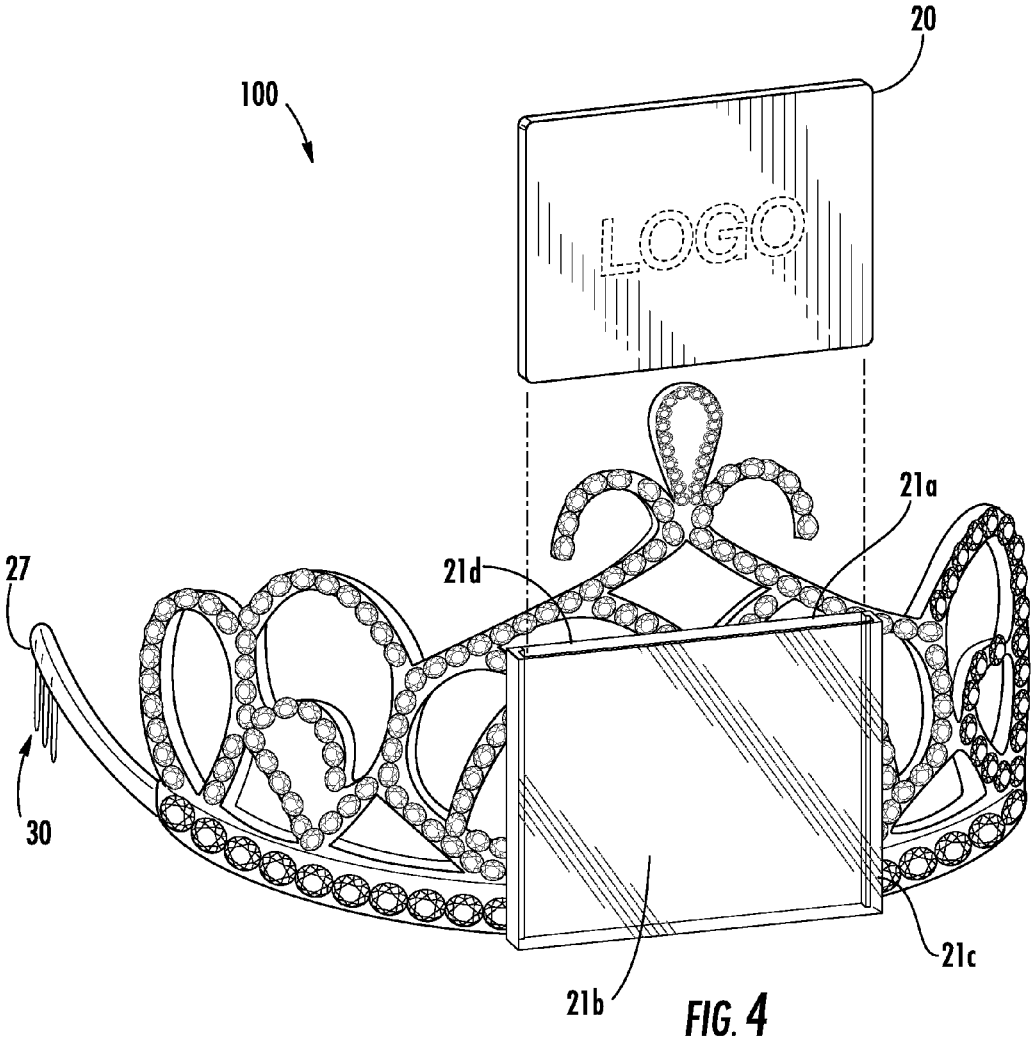
FIG. 4 is a view of a fourth embodiment of the invention having a "picture frame" slide.

Referring to FIG. 4 is a tiara having an alternative attachment member 11 in the form of a clear slide 21. The slide 21 is preferably mounted to the outside surface of the tiara on portions of the wire 16 and is preferably mounted using an adhesive such as epoxy or industrial strength glue. The slide contains 3 portions: a mounting portion 21*a*, a protective portion 21*b*, and a frame portion 21*c*.

The mounting portion 21*a* is mounted to the outside surface of the tiara and the frame portion 21*c* is preferably attached to the mounting portion 21*a* in a secure manner such that the frame may not be removed by the user. The frame portion 21*c* follows the perimeter of the mounting portion much like a picture frame, leaving an opening or slot 21*d* along one side of the frame such that the protective portion 21*b* can be easily slid through it. The slit should also have a sufficient width so as to allow the placement of the display element 20 between the mounting portion 21*a* and protective portion 21*b*. The protective portion may be a plastic, plexiglass or glass piece configured to slide within the slot of frame portion 21*c*. The protective portion 21*b* serves to cover the display element 20 such that it remains secured to the tiara and also protected from the outside elements. The slot is preferably located on the top side of the slide such that the display element may not fall out of the slide when in use.

In one embodiment, the mounting portion, frame portion and protective portion are all one piece with no movable parts except for the ability of the user to insert the desired display element 20 within the slot 21*d*. The elements of the slide may be constructed of any suitable material, including a plastic, rubber or metal material. The slide may have a variety of shapes, including an oval, rectangle, square, circle or non-geometric shape. For example, FIG. 4 shows the slide 21 having a generally rectangular shape.

Figure 5:
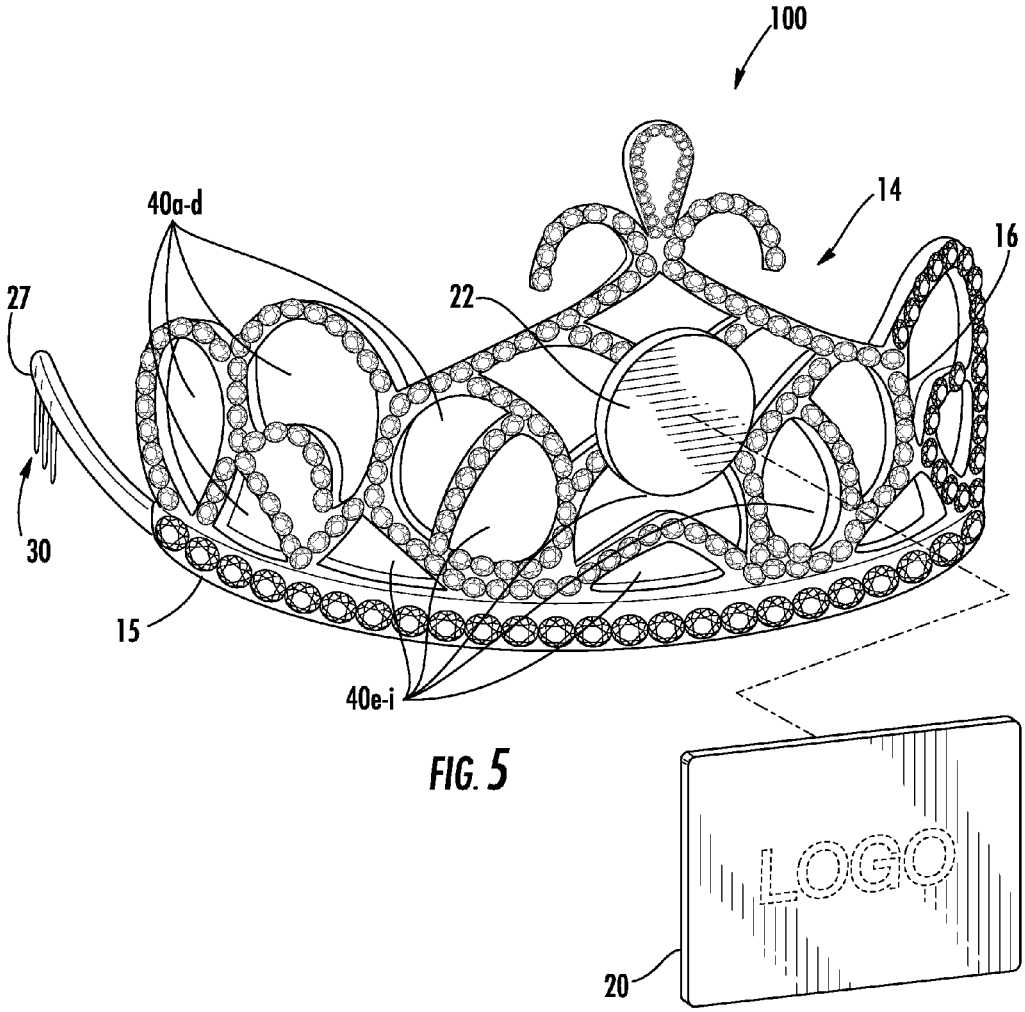
FIG. 5 is a view of a fifth embodiment of the invention having a magnet.
Figure 6A:
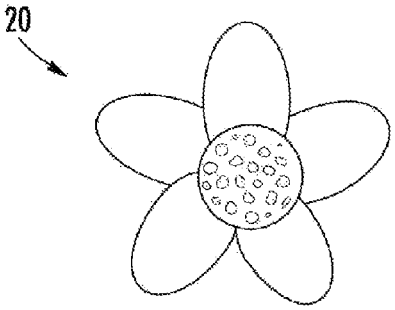
FIGS. 6A, 6B, 6C and 6D show alternative embodiments of the display element.
Figure 6B:
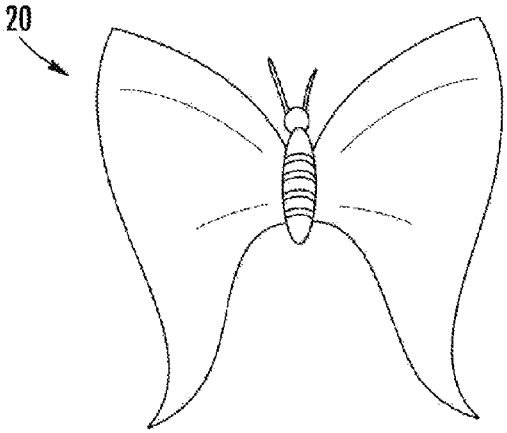
Figure 6C:
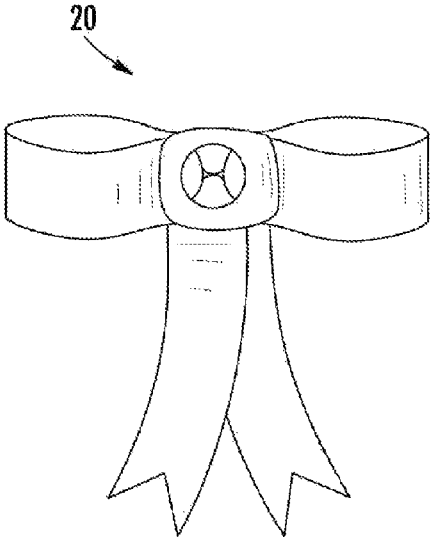
Figure 6D:
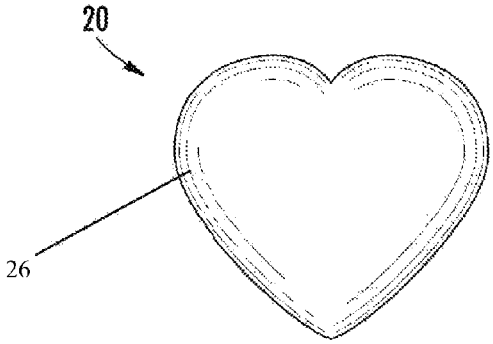
Figure 7:
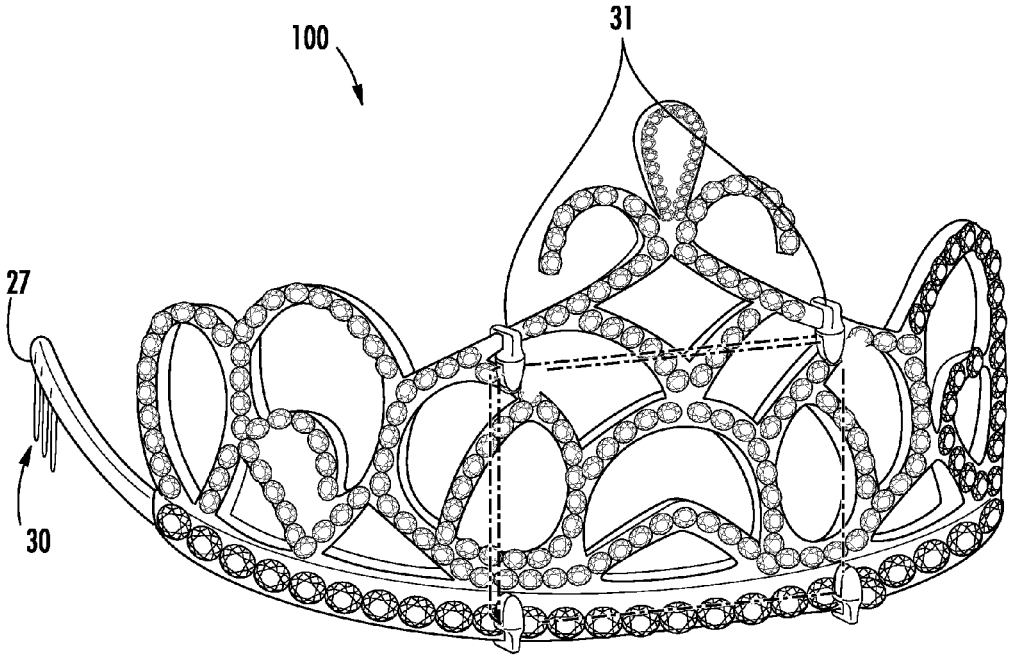
FIGS. 7, 8A and 8B are views of the sixth embodiment of the invention having an adjustable expansion clamp feature.

Referring to FIG. 5 is a tiara having an alternative attachment member 11 in the form of a magnet 22. A magnetic material may be placed on the outside surface of the tiara or wire 16. Another magnetic material having an opposite polarity may be placed on the inward facing surface of the display element 20. The opposing polarities of the magnetic materials operate to cause the display element 20 to stay in the user's desired location. In one embodiment, the display element itself could be constructed partially or entirely out of a magnetic material such as steel or another attractive metal material or mixture of metal materials. The magnetic material may be secured to the outside surface of the tiara or wire 16 using an adhesive such as epoxy or industrial strength glue. In another embodiment, the magnetic material may be secured to the tiara using one or more of the prongs, hooks or clips described above.

Figure 8A:
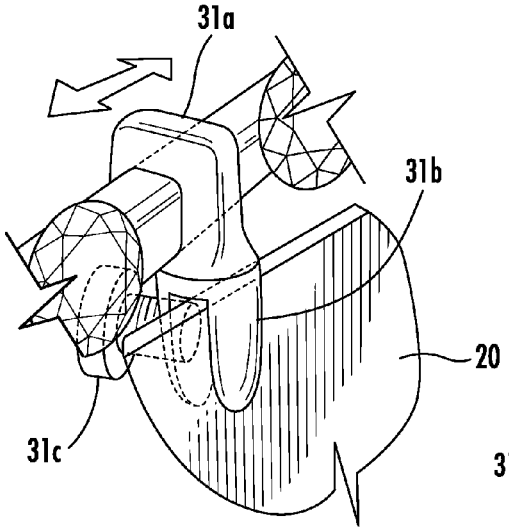
Figure 8B:
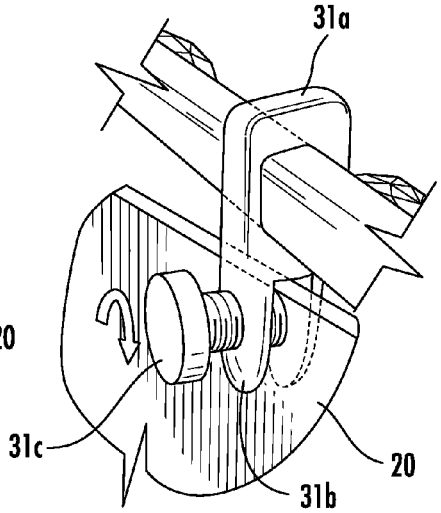

Referring to FIGS. 6A, 6B, 6C and 6D is a tiara having one or more adjustable expansion clamps 31. These adjustable clamps are designed to be expanded and contracted by the user by twisting or rotating screw 31*c*, as is shown in FIGS. 8A and B. In this way, the clamps may hold in place a number of different display elements 20 having varying thicknesses. These clamps may also be slid along the frame portion of the tiara in order to accommodate varying geometric sizes of the display elements. The expansion clamps may be removably attached to the tiara or may be in attached in a more stationary manner, depending on the needs of the user. As shown in FIGS. 8A and 8B, screw portion 31*c* may be rotated by the user in order to loosen or tighten the lower portion 31*b* of the expansion clamp and thereby accommodate a varying sized display element. The upper portion 31*a* may also be equipped with an expansion element in order to accommodate sliding of the clamp along the frame and/or removing the clamp altogether. The upper portion 31*a* may have any other conventional mechanism for removable attachment to the frame. The screw 31*c* may be facing either direction such that the head of the screw is facing inwards and hidden from view, or facing outwards. In the case that the head of the screw is facing outwards, a rhinestone or other decorative piece may be placed thereon for aesthetic purposes.

Figure 9:
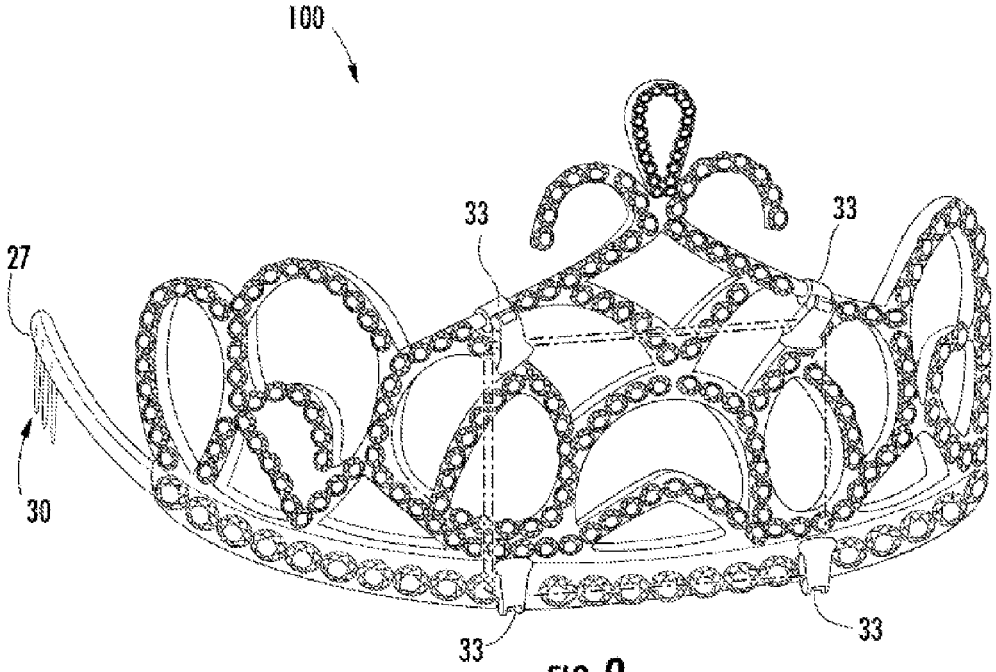
FIGS. 9, 10A and 10B are views of the seventh embodiment of the invention having an adjustable clip feature.
Figure 10A:
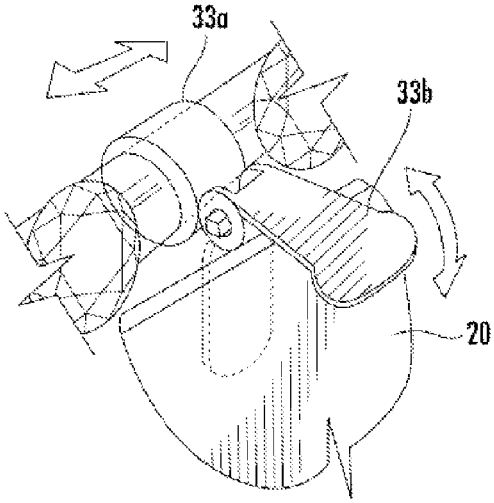
Figure 10B:
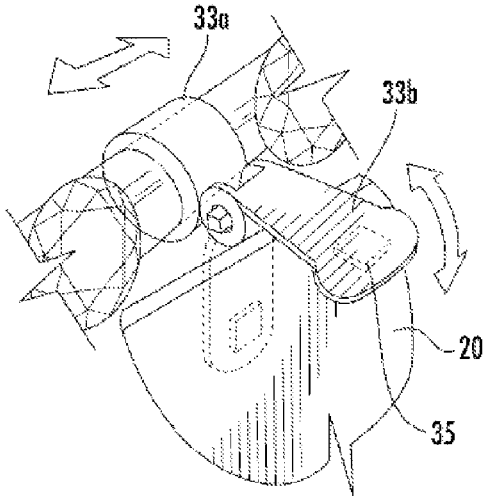

Referring to FIGS. 9, 10A and 10B is a tiara having one or more adjustable clips 33. Upper portion 33*a* of clip 33 is secured to any part of the frame of the tiara and may be removably attached to the tiara or may be in attached in a more stationary manner, depending on the needs of the user. Like the expansion clamps, these adjustable clips 33 may also be slid along the frame portion of the tiara in order to accommodate varying geometric sizes and shapes of the display elements. A user is to press down on portion 33*b* in order to engage the display element 20 and flip up portion 33*b* in order to disengage the display element. In this way, the adjustable clips 33 are also able to accommodate display elements of varying thickness.

While several particular forms of the invention have been illustrated and described, it will be apparent that various modifications and combinations of the invention detailed in the text and drawings can be made without departing from the spirit and scope of the invention. For example, references to materials of construction, methods of construction, specific dimensions, shapes, utilities or applications are also not intended to be limiting in any manner and other materials and dimensions could be substituted and remain within the spirit and scope of the invention. Accordingly, it is not intended that the invention be limited, except as by the appended claims.

We claim:

1. A tiara having an interchangeable display element, comprising:

a) a C shaped band member configured to be worn around the head of a wearer, the band member having a bottom surface configured to be in contact with the wearer's head, a top surface, an inward facing surface and an outward facing surface, b) an ornamental crown section being secured to the top surface of the band member at one or more points along the band member and extending up from the band member along substantially the same plane as the band member, the crown section comprising an outward facing side having a plurality of ornamental gaps on a surface of the crown section, and c) a first attachment member having a first end and a second end wherein the first end is secured directly to the outward facing surface of the band member and the second end is in detachable connection with a display element, a second attachment member having a first end and a second end wherein the first end of the second attachment member is secured directly to the crown section and the second end of the second attachment member is in detachable connection with said display element, and a third attachment member having a first end and a second end wherein the first end of the third attachment member is secured to ornamental crown section or band member and the second end of the third attachment member is in detachable connection with the display element;

wherein the first attachment member comprises a hook, prong or clip;

wherein the first attachment member comprises a first lip, the second attachment member comprises a second lip, and the third attachment member comprises a third lip to restrict movement of the display element, and wherein the first attachment member and second attachment member are separate units that receive the display element therebetween.

2. The tiara of claim 1, wherein the second attachment member comprises a hook, prong, or clip secured to the outward facing side of the crown section.

3. The tiara of claim 1, wherein the display element includes a ridge or indentation along at least a portion of a perimeter of the display element.

4. The tiara of claim 1, wherein said display element comprises a lower edge in detachable connection with the first attachment member and an upper edge in detachable connection with the second attachment member.

5. A method of making a tiara having an interchangeable display element, the method comprising:

a) providing a tiara comprising:

i) a C-shaped band member configured to be worn around the head of a wearer, the band member having a bottom surface configured to be in contact with the wearer's head, a top surface, an inward facing surface and an outward facing surface, and, ii) an ornamental crown section being secured to the top surface of the band member at one or more points along the band member and extending up from the band member along the same plane as the band member, the crown section comprising an outward facing side having a plurality of ornamental gaps on a surface of the crown section, and b) securing a first attachment member having a first end and a second end such that the first end is secured directly to the outward facing surface of the band member and the second end is in detachable connection with a display element, a second attachment member having a first end and a second end wherein the first end of the second attachment member is secured directly to the crown section and the second end of the second attachment member is in detachable connection with said display element, and a third attachment member having a first end and a second end wherein the first end of the third attachment member is secured to ornamental crown section or band member and the second end of the third attachment member is in detachable connection with the display element;

wherein the first attachment member comprises a hook, prong or clip;

wherein the first attachment member comprises a first lip, the second attachment member comprises a second lip, and the third attachment member comprises a third lip to restrict movement of said display element;

and wherein the first attachment member and second attachment member are disconnected units that receive the display element therebetween.

6. The method of claim 5, wherein the second attachment member comprises a hook, prong, or clip secured on the outward facing side of the crown section.

7. The method of claim 5, wherein the display element comprises a ridge or indentation along at least a portion of a perimeter of the display element.

8. A kit for assembling a tiara having interchangeable display elements, comprising:

a tiara comprising:

i) a C-shaped band member configured to be worn around the head of a wearer, the band member having a bottom surface configured to be in contact with the wearer's head, a top surface, an inward facing surface and an outward facing surface, ii) an ornamental crown section being secured to the top surface of the band member at one or more points along the band member and extending up from the band member along the same plane as the band member, the crown section comprising an outward facing side having a plurality of ornamental gaps on a surface of the crown section, and iii) a first attachment member having a first end and a second end wherein the first end is secured directly to the outward facing surface of the band member and the second end is in detachable connection with a display element, a second attachment member having a first end and a second end wherein the first end of the second attachment member is secured directly to the crown section and the second end of the second attachment member is in detachable connection with said display element, and a third attachment member having a first end and a second end wherein the first end of the third attachment member is secured to ornamental crown section or band member and the second end of the third attachment member is in detachable connection with the display element;

wherein the first attachment member comprises a first lip, the second attachment member comprises a second lip, and the third attachment member comprises a third lip to restrict movement of said display element;

wherein the first attachment member and second attachment member are disconnected units that receive the display element therebetween.

* * * * *